US012704287B2

(12) United States Patent
Ahn

(10) Patent No.: US 12,704,287 B2
(45) Date of Patent: Aug. 11, 2026

(54) AIR CONDITIONER

(71) Applicant: LG ELECTRONICS INC., Seoul (KR)

(72) Inventor: Hyoshik Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 139 days.

(21) Appl. No.: 18/898,241

(22) Filed: Sep. 26, 2024

(65) Prior Publication Data

US 2025/0102180 A1 Mar. 27, 2025

(30) Foreign Application Priority Data

Sep. 27, 2023 (KR) ..... 10-2023-0130113

(51) Int. Cl.
*F24F 11/83* (2018.01)

(52) U.S. Cl.
CPC ..... *F24F 11/83* (2018.01)

(58) Field of Classification Search
CPC .. F24F 11/83; F24F 11/54; F24F 11/62; F24F 11/65; F24F 11/30; F24F 11/64; F24F 11/61; F24F 11/89; F24F 11/63; F24F 11/46
See application file for complete search history.

(56) References Cited

U.S. PATENT DOCUMENTS

| | | | | |
|---|---|---|---|---|
| 7,870,750 | B2 * | 1/2011 | Yoon | F24F 11/52 62/175 |
| 9,303,930 | B2 * | 4/2016 | Ishizaka | F24F 11/46 |
| 11,231,216 | B2 * | 1/2022 | Jung | F25B 13/00 |
| 2016/0252284 | A1 * | 9/2016 | Kibo | F24F 11/86 62/115 |
| 2022/0205671 | A1 * | 6/2022 | Hamashima | F25B 41/30 |
| 2022/0404057 | A1 * | 12/2022 | Park | F24F 11/63 |
| 2023/0109940 | A1 | 4/2023 | Choi et al. | |
| 2023/0124335 | A1 | 4/2023 | Ochiai | |

FOREIGN PATENT DOCUMENTS

| | | | |
|---|---|---|---|
| CN | 101231017 | A | 7/2008 |
| EP | 3 869 123 | A1 | 8/2021 |
| KR | 10-2022-0106351 | A | 7/2022 |

* cited by examiner

*Primary Examiner* — Nelson J Nieves
(74) *Attorney, Agent, or Firm* — Birch, Stewart, Kolasch & Birch, LLP

(57) ABSTRACT

The present disclosure relates to an air conditioner. An air conditioner according to an embodiment of the present disclosure may include: an outdoor unit; a plurality of indoor units disposed to correspond to a plurality of regions, respectively; temperature sensors sensing indoor temperatures for the plurality of regions corresponding to the plurality of indoor units, respectively; and a controller, and the controller may group the plurality of indoor units into at least one group when powers of two or more indoor units adjacent to each other among the plurality of indoor units are on, determine at least one of the plurality of indoor units as a target of an operation control based on a priority for the at least one group, and stop an operation of the indoor unit determined as the target of the operation control. Various other embodiments are possible.

10 Claims, 12 Drawing Sheets

FIG. 7

400

| | | | |
|---|---|---|---|
| (1.1) OFF | (1.2) ON<br>24/26 | (1.3) ON<br>24/24<br>(NO.3) | (1.4) OFF |
| (2.1) ON<br>23/26 | (2.2) ON<br>24/23<br>(NO.1) | (2.3) ON<br>24/24<br>(NO.3) | (2.4) ON<br>25/24<br>(NO.2) |
| (3.1) OFF | (3.2) ON<br>26/25<br>(NO.2) | (3.3) OFF | (3.4) ON<br>24/24<br>(NO.3) |
| (4.1) OFF | (4.2) OFF | (4.3) ON<br>25/27 | (4.4) ON<br>24/25 |

<701>

400

| | | | |
|---|---|---|---|
| (1.1) OFF | (1.2) ON<br>24/26 | (1.3) OFF<br>24/24<br>(NO.3) | (1.4) OFF |
| (2.1) ON<br>23/26 | (2.2) OFF<br>24/23<br>(NO.1) | (2.3) ON<br>24/24<br>(NO.3:Waiting) | (2.4) OFF<br>25/24<br>(NO.2) |
| (3.1) OFF | (3.2) ON<br>26/25<br>(NO.2:Waiting) | (3.3) OFF | (3.4) ON<br>24/24<br>(NO.3:Waiting) |
| (4.1) OFF | (4.2) OFF | (4.3) ON<br>25/27 | (4.4) ON<br>24/25 |

<702>

FIG. 8

400

| | | | |
|---|---|---|---|
| (1.1) OFF | (1.2) ON<br>24/25 | (1.3) OFF<br>24/25 | (1.4) OFF |
| (2.1) ON<br>23/25 | (2.2) OFF<br>24/24<br>(NO.3) | (2.3) ON<br>24/24<br>(NO.3:Waiting) | (2.4) OFF<br>25/25<br>(NO.3) |
| (3.1) OFF | (3.2) ON<br>26/25<br>(NO.1) | (3.3) OFF | (3.4) ON<br>24/24<br>(NO.3:Waiting) |
| (4.1) ON<br>24/26 | (4.2) OFF | (4.3) ON<br>25/26 | (4.4) ON<br>24/24<br>(NO.3) |

<801>

400

| | | | |
|---|---|---|---|
| (1.1) OFF | (1.2) ON<br>24/25 | (1.3) ON<br>24/25 | (1.4) OFF |
| (2.1) ON<br>23/25 | (2.2) ON<br>24/24<br>(NO.3) | (2.3) OFF<br>24/24<br>(NO.3) | (2.4) ON<br>25/25<br>(NO.3) |
| (3.1) OFF | (3.2) OFF<br>26/25<br>(NO.1) | (3.3) OFF | (3.4) ON<br>24/24<br>(NO.3:Waiting2) |
| (4.1) ON<br>24/26 | (4.2) OFF | (4.3) ON<br>25/26 | (4.4) ON<br>24/24<br>(NO.3:Waiting) |

<802>

FIG. 9

400

| | | | |
|---|---|---|---|
| (1.1) OFF | (1.2) ON<br>24/25 | (1.3) ON<br>24/24<br>(NO.3) | (1.4) OFF |
| (2.1) ON<br>23/24 | (2.2) ON<br>24/24<br>(NO.3) | (2.3) OFF<br>24/24<br>(NO.3) | (2.4) ON<br>25/25<br>(NO.3) |
| (3.1) OFF | (3.2) OFF<br>26/26<br>(NO.3) | (3.3) OFF | (3.4) ON<br>24/24<br>(NO.3:Waiting2) |
| (4.1) ON<br>24/25 | (4.2) OFF | (4.3) ON<br>25/25<br>(NO.3) | (4.4) ON<br>24/24<br>(NO.3:Waiting) |

<901>

400

| | | | |
|---|---|---|---|
| (1.1) OFF | (1.2) ON<br>24/25 | (1.3) ON<br>24/24<br>(NO.3:Waiting) | (1.4) OFF |
| (2.1) ON<br>23/24 | (2.2) ON<br>24/24<br>(NO.3:Waiting) | (2.3) ON<br>24/24<br>(NO.3) | (2.4) ON<br>25/25<br>(NO.3:Waiting) |
| (3.1) OFF | (3.2) ON<br>26/26<br>(NO.3) | (3.3) OFF | (3.4) OFF<br>24/24<br>(NO.3) |
| (4.1) ON<br>24/25 | (4.2) OFF | (4.3) ON<br>25/25<br>(NO.3:Waiting) | (4.4) ON<br>24/24<br>(NO.3:Waiting2) |

<902>

FIG. 10

400

| | | | |
|---|---|---|---|
| (1.1) OFF | (1.2) ON<br>24/24<br>(NO.3) | (1.3) ON<br>24/24<br>(NO.3:Waiting) | (1.4) OFF |
| (2.1) ON<br>23/24 | (2.2) ON<br>24/23<br>(NO.1) | (2.3) ON<br>24/23<br>(NO.2) | (2.4) ON<br>25/25<br>(NO.3:Waiting) |
| (3.1) OFF | (3.2) ON<br>26/26<br>(NO.3) | (3.3) OFF | (3.4) OFF<br>24/25 |
| (4.1) ON<br>24/24 | (4.2) OFF | (4.3) ON<br>25/25<br>(NO.3:Waiting) | (4.4) ON<br>24/24<br>(NO.3:Waiting2) |

<1001>

400

| | | | |
|---|---|---|---|
| (1.1) OFF | (1.2) ON<br>24/24<br>(NO.3:Waiting) | (1.3) ON<br>24/24<br>(NO.3:Waiting2) | (1.4) OFF |
| (2.1) ON<br>23/24 | (2.2) OFF<br>24/23<br>(NO.1) | (2.3) ON<br>24/23<br>(NO.2:Waiting) | (2.4) ON<br>25/25<br>(NO.3:Waiting2) |
| (3.1) OFF | (3.2) ON<br>26/26<br>(NO.3:Waiting) | (3.3) OFF | (3.4) ON<br>24/25 |
| (4.1) ON<br>24/24 | (4.2) OFF | (4.3) ON<br>25/25<br>(NO.3:Waiting2) | (4.4) OFF<br>24/24<br>(NO.3) |

<1002>

FIG. 11

400

| | | | |
|---|---|---|---|
| (1.1) OFF | (1.2) ON<br>24/24<br>(NO.3:Waiting) | (1.3) ON<br>24/24<br>(NO.3:Waiting2) | (1.4) OFF |
| (2.1) ON<br>23/23 | (2.2) OFF | (2.3) ON<br>24/23<br>(NO.1) | (2.4) ON<br>25/25<br>(NO.3:Waiting2) |
| (3.1) OFF | (3.2) ON<br>26/25 | (3.3) OFF | (3.4) ON<br>24/24<br>(NO.3) |
| (4.1) ON<br>24/24 | (4.2) OFF | (4.3) ON<br>25/25<br>(NO.3:Waiting2) | (4.4) OFF<br>24/24<br>(NO.3) |

<1101>

400

| | | | |
|---|---|---|---|
| (1.1) OFF | (1.2) ON<br>24/24<br>(NO.3:Waiting2) | (1.3) ON<br>24/24<br>(NO.3:Waiting3) | (1.4) OFF |
| (2.1) ON<br>23/23 | (2.2) OFF | (2.3) OFF<br>24/23<br>(NO.1) | (2.4) ON<br>25/25<br>(NO.3:Waiting3) |
| (3.1) OFF | (3.2) ON<br>26/25 | (3.3) OFF | (3.4) ON<br>24/24<br>(NO.3:Waiting) |
| (4.1) ON<br>24/24 | (4.2) OFF | (4.3) OFF<br>25/25<br>(NO.3) | (4.4) ON<br>24/24<br>(NO.3) |

<1102>

AIR CONDITIONER

CROSS REFERENCE TO RELATED APPLICATIONS

This non-provisional application claims the benefit under 35 U.S.C. § 119 (a) to Patent Application No. 10-2023-0130113, filed in the Republic of Korea on Sep. 27, 2023, which is hereby expressly incorporated by reference into the present application.

TECHNICAL FIELD

The present disclosure relates to an air conditioner, and particularly, to an air conditioner which may control operations of multiple indoor units.

BACKGROUND

In order to create a pleasant indoor environment, an air conditioner is installed to provide humans with a more comfortable indoor environment by discharging the air at a cold hot temperature to the room to adjust a room temperature and purify indoor air. In general, the air conditioner includes an indoor unit constituted by a heat exchanger and installed in the room, and an outdoor unit constituted by a compressor and the heat exchanger, and supplying refrigerant to the indoor unit.

The air conditioner is cooling-operated or heating-operated according to the flow of the refrigerant. During the cooling operation, high-temperature and high-pressure liquid refrigerant is supplied to the indoor unit from the compressor of the outdoor unit via the heat exchanger of the outdoor unit, and a temperature of surrounding air is lowered while the refrigerant is expanded and vaporized in the heat exchanger of the indoor unit, and as an indoor unit fan rotates, cooling air is discharged to the room. During the heating operation, high-temperature and high-pressure gas refrigerant is supplied to the indoor unit from the compressor of the outdoor unit, and air which is warmed by energy emitted while the high-temperature and high-pressure gas refrigerant is liquefied is discharged to the room according to an operation of the indoor fan in the heat exchanger of the indoor unit.

On the other hand, when the air conditioner includes a plurality of indoor units, cooling-temperature air can be supplied to each of a plurality of regions of an indoor space by using the plurality of indoor units. Further, cooling-temperature air discharged from a specific indoor unit can influence a region corresponding to the specific indoor unit, and the other region adjacent thereto. As described above, it is necessary to study a method for more efficiently controlling operations of the indoor units by considering a correlation between indoor units in the case of cooling and heating the indoor space by using the plurality of indoor units.

SUMMARY

In view of the above, the present disclosure solves the above-described problems and other problems.

The present disclosure also provides an air conditioner capable of grouping a plurality of indoor units according to a priority for an operation control.

The present disclosure also provides an air conditioner capable of determining an indoor unit which is a target of the operation control by considering an influence exerted on an adjacent region.

The present disclosure also provides an air conditioner capable of minimizing an unnecessary operation control for the indoor unit.

In order to achieve the objects, according to an embodiment of the present disclosure, an air conditioner may include: an outdoor unit; a plurality of indoor units disposed to correspond to a plurality of regions, respectively; temperature sensors sensing indoor temperatures for the plurality of regions corresponding to the plurality of indoor units, respectively; and a controller, and the controller may group the plurality of indoor units into at least one group when powers of two or more indoor units adjacent to each other among the plurality of indoor units are on, determine at least one of the plurality of indoor units as a target of an operation control based on a priority for the at least one group, and stop an operation of the indoor unit determined as the target of the operation control.

Effects of the air conditioner according to the present invention will be described below.

According to at least one embodiment of the present disclosure, the plurality of indoor units may be grouped according to the priority for the operation control.

Further, according to at least one embodiment of the present disclosure, an indoor unit which is a target of the operation control may be determined by considering an influence exerted on an adjacent region.

According to at least one embodiment of the present disclosure, an unnecessary operation control for the indoor unit may be minimized.

An additional range of an applicability of the present disclosure will be apparent from the following detailed description. However, since various changes and modifications can be clearly appreciated by those skilled in the art within the spirit and the scope of the present disclosure, the detailed description and a specific embodiment such as a preferred embodiment of the present disclosure should be appreciated as being just given as an example.

BRIEF DESCRIPTION OF THE DRAWINGS

FIGS. 6 to 11 are diagrams referenced for describing an operation of the air conditioner according to an embodiment of the present disclosure.

DETAILED DESCRIPTION

Figure 1A:
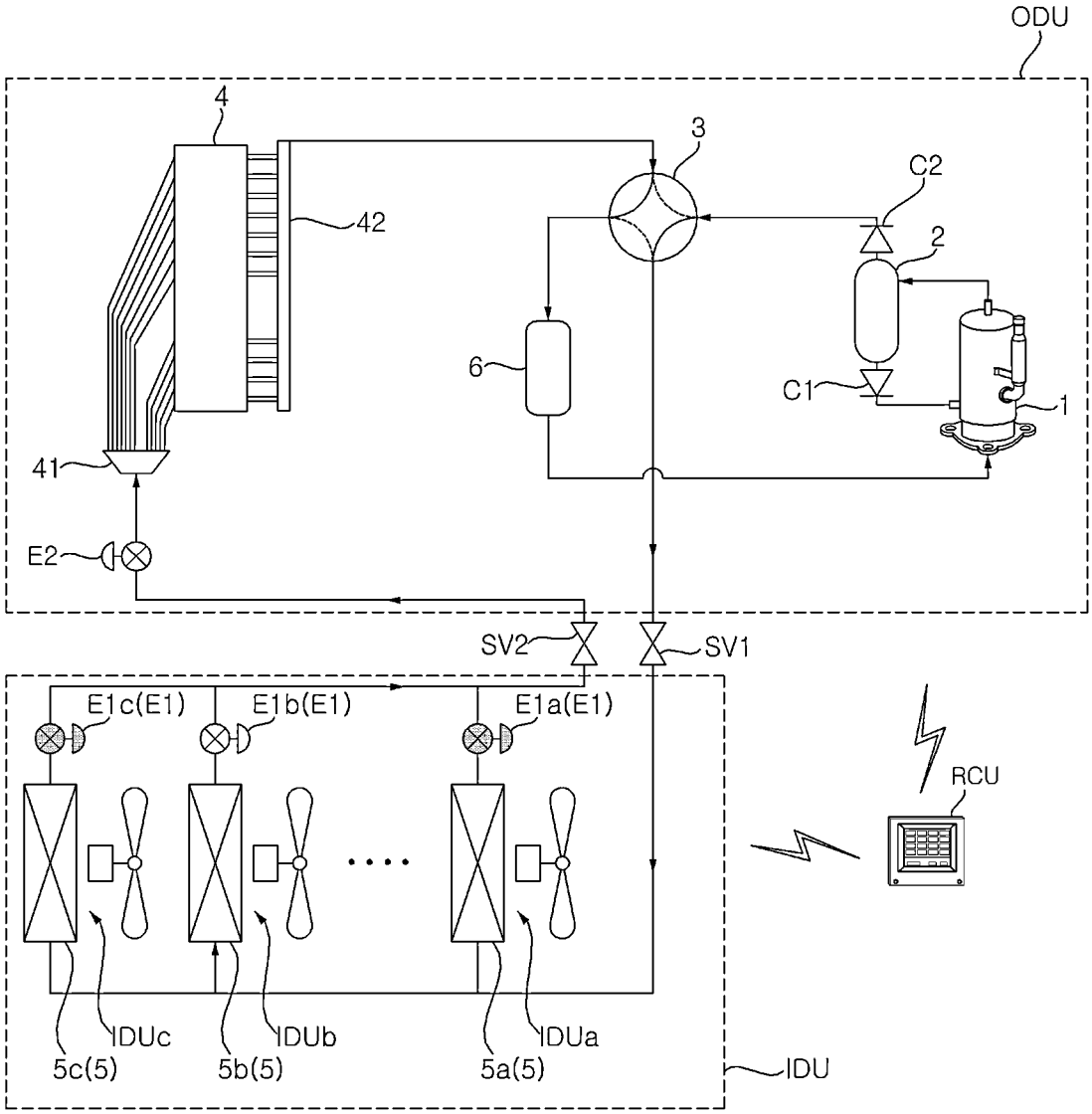
FIGS. 1A and 1B are diagrams illustrating a configuration of an air conditioner according to an embodiment of the present disclosure.

A sample detection device 1 according to an embodiment of the present disclosure may obtain an enlarged image of a sample 3 using light emitted from a light source 2. Hereinafter, the present disclosure will be described in detail with reference to drawings. In the drawings, in order to clearly and briefly describe the present disclosure, illustration of a part which is not related to the description is omitted, and throughout the present disclosure, the same or extremely similar part are denoted by the same reference numeral.

Suffixes "module" and "unit" for components used in the following description are given in consideration of easy preparation of the specification only and do not have their own particularly important meanings or roles. Accordingly, the "module" and "unit" may be used interchangeably.

In the present application, it should be understood that term "include" or "have" indicates that a feature, a number, a step, an operation, a component, a part or the combination thereof described in the specification is present, but does not exclude a possibility of presence or addition of one or more other features, numbers, steps, operations, components, parts or combinations thereof, in advance.

Further, in the present disclosure, the terms such as first, second, etc., may be used for describing various components, but the components are not limited by the terms. The terms are used for distinguishing one component from another component.

Figure 1B:
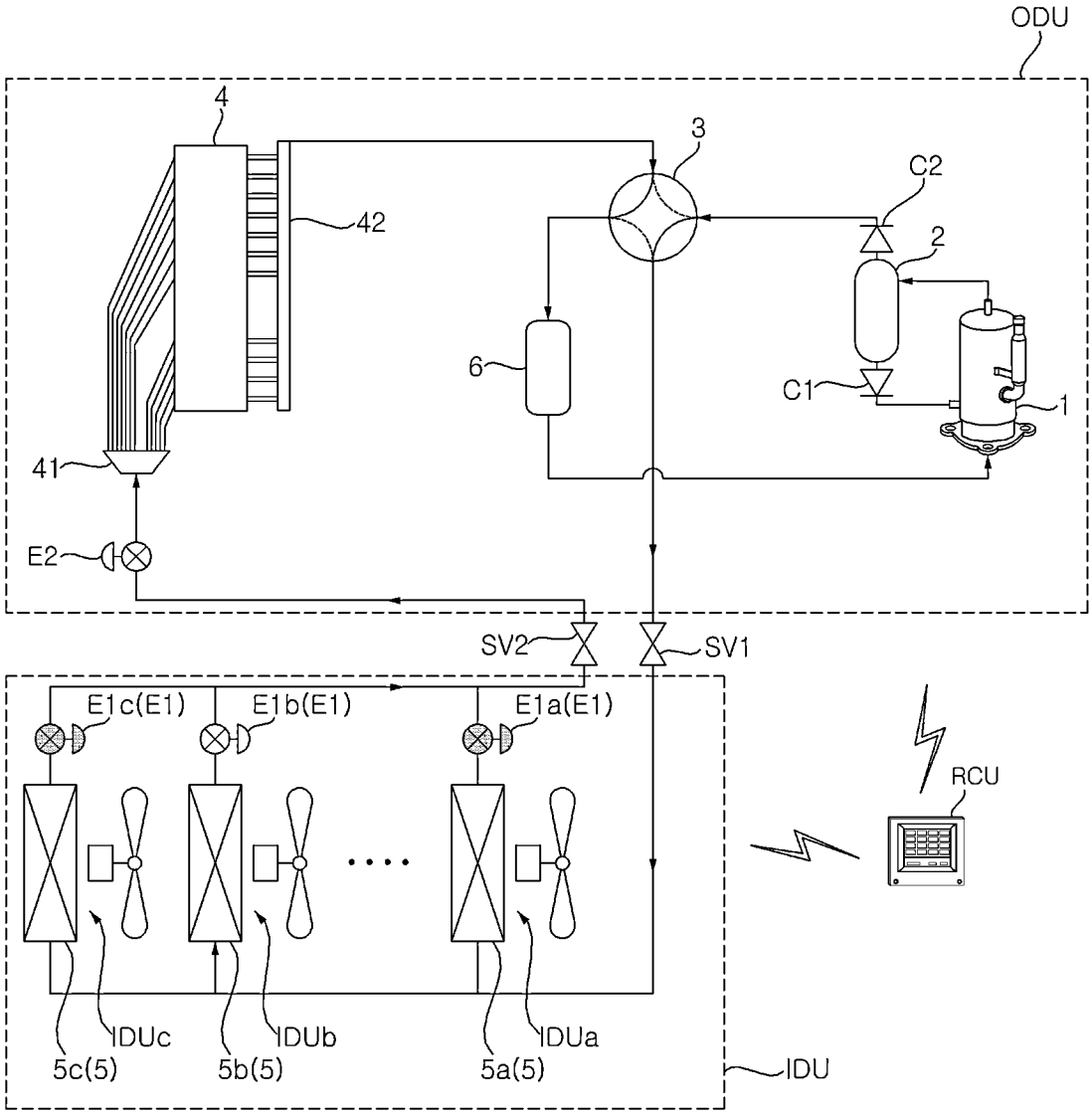

FIGS. 1A and 1B are diagrams illustrating a configuration of an air conditioner according to an embodiment of the present disclosure.

Referring to FIGS. 1A and 1B, the air conditioner may include an outdoor unit ODU and an indoor unit IDU connected to each other by a refrigerant pipe. The air conditioner may further include a remote control unit (RCU). The outdoor unit ODU, the indoor unit IDU, and/or the remote control unit RCU may transmit and receive signals to and from each other.

The outdoor unit ODU may include a compressor 1, an oil separator 2, a switching valve 3, an outdoor heat exchanger 4, an outdoor expansion valve E2, and/or an accumulator 6. The outdoor unit IDU may include an indoor heat exchanger 5 and an indoor expansion valve E1.

The compressor 1 may compress refrigerant introduced from the accumulator 6 at high temperature and at high pressure. For example, the compressor 1 may be an inverter compressor that adjusts an operating frequency to control a refrigerant amount and s discharge pressure of the refrigerant. For example, the compressor 1 may be an oil compressor using oil as a lubricant.

The oil separator 2 may recover the oil from the refrigerant discharged from the compressor 1, and provide the recovered oil to the compressor 1 again. In this case, a first check valve C1 is installed in a pipe in which the oil separated by the oil separator 2 flows, and a flowing direction of the oil may be limited to a direction from the oil separator 2 to the compressor 1.

The switching valve 3 may selectively guide the refrigerant introduced from the oil separator 2 to the outdoor heat exchanger 4 or the indoor heat exchanger 5. For example, the switching valve 3 may be a 4-way valve.

The outdoor heat exchanger 4 may heat-exchange the refrigerant and outdoor air. A heat transfer direction between the refrigerant and the outdoor air in the outdoor heat exchanger 4 may vary depending on an operation mode of the air conditioner, i.e., the heating operation or the cooling operation. An outdoor fan (not illustrated) is installed at one side of the outdoor heat exchanger 4 to adjust the amount of air provided to the outdoor heat exchanger 4.

The indoor heat exchanger 5 may heat-exchange the refrigerant and indoor air. A heat transfer direction between the refrigerant and the indoor air in the indoor heat exchanger 5 may vary depending on the operation mode of the air conditioner, i.e., the heating operation or the cooling operation. An indoor fan (not illustrated) is installed at one side of the indoor heat exchanger 5 to adjust the amount of air provided to the indoor heat exchanger 5.

For example, the indoor heat exchanger 5 may include a plurality of indoor heat exchangers 5*a*, 5*b*, and 5*c*. In this case, the indoor unit IDU may include a first outdoor unit IDUa including a first indoor heat exchanger 5*a*, a first indoor fan, and a first indoor expansion valve E1*a*, a second indoor unit IDUb including a second indoor heat exchanger 5*b*, a second indoor fan, and a second indoor expansion valve E1*b*, and a third indoor unit IDUc including a third indoor heat exchanger 5*c*, a third indoor fan, and a third indoor expansion valve E1*c*. Meanwhile, some of the plurality of indoor heat exchangers 5*a*, 5*b*, and 5*c* may be operated, and the remaining indoor heat exchangers may be non-operated, in response to a cooling or heating required load of the room.

The expansion valves E1 and E2 are installed between the outdoor heat exchanger 4 and the indoor heat exchange 5 to expand the refrigerant which passes through the outdoor heat exchanger 4 or the indoor heat exchanger 5. In addition, the expansion valves E1 and E2 may include the outdoor expansion valve E2 adjacent to the outdoor heat exchanger 4 and the indoor expansion valve E1 adjacent to the indoor heat exchanger 5. In this case, the outdoor expansion valve E2 may be used for expanding the refrigerant which passes through the indoor heat exchanger 5, and the indoor expansion valve E1 may be used for expanding the refrigerant which passes through the outdoor heat exchanger 4. For example, the expansion valves E1 and E2 may be electronic expansion valves (EEVs) capable of adjusting an opening level of a path of the refrigerant pipe in which the expansion valves E1 and E2 are installed.

For example, the indoor expansion valve E1 may include a first indoor expansion valve Ela expanding the refrigerant provided to the first indoor heat exchanger 5*a*, a second indoor expansion valve E1*b* expanding the refrigerant provided to the second indoor heat exchanger 5*b*, and a third indoor expansion valve E1*c* expanding the refrigerant provided to the third indoor heat exchanger 5*c*.

A plurality of sensors (not illustrated) may measure a temperature and/or a pressure of the refrigerant which flows in the refrigerant pipe.

A controller (not illustrated) is electrically connected to each component of the air conditioner to control the operation of each component of the air conditioner.

Referring to FIG. 1A, when a cooling operation signal is input into the air conditioner, the controller may perform the heating operation of the air conditioner. For example, the heating operation signal may be a signal arbitrarily input by a user. As another example, the heating operation signal may be a signal which a thermostat provided in the indoor space provides to the controller when an indoor temperature sensed by an indoor-side temperature sensor is lower than a desired temperature set by the user by a predetermined level or more.

Specifically, low-temperature and low-pressure refrigerant which is introduced from the accumulator 6 into the compressor 1 may be compressed at the high temperature and the high pressure by the compressor 1 and discharged to the oil separator 2. In addition, the refrigerant from which the oil is separated by the oil separator 2 may be introduced into the second indoor heat exchanger 5*b* via the switching valve 3 and a first service valve SV1. In this case, the second indoor expansion valve E1*b* may completely open a path of the refrigerant, which is linked to the outdoor heat exchanger 4 by passing through the second indoor heat exchanger 5*b*. In addition, the first indoor expansion valve E1*a* and a third indoor expansion valve E1*c* may close a path of the refrigerant, which is linked to the outdoor heat exchanger 4 by passing through the first indoor heat exchanger 5*a* and the third indoor heat exchanger 5*c*. Further, when a required heating load increases, the first indoor expansion valve E1*a* and/or the third indoor expansion valve E1*c* may also be opened.

As heat energy is transferred from the refrigerant to the indoor air in the second indoor heat exchanger 5*b*, the refrigerant may be condensed. In this case, the second indoor heat exchanger 5*b* may serve as a condenser. In addition, the indoor space may be heated according to the heat exchange between the refrigerant and the indoor air. The refrigerant condensed while passing through the second indoor heat exchanger 5*b* may pass through the outdoor expansion valve E2 via the second indoor expansion valve E1*b* and a second service valve SV2. Refrigerant expanded while passing through the outdoor expansion valve E2 may be distributed to a plurality of points of the outdoor heat exchanger 4 via a distributor 41.

As the heat energy of the outdoor air is transferred to the refrigerant in the outdoor heat exchanger 4, the refrigerant may be evaporated. In this case, the outdoor heat exchanger 4 may serve as an evaporator. The refrigerant evaporated while passing through the outdoor heat exchanger 4 may be introduced into the compressor 1 via a header 42, the switching valve 3, and the accumulator 6 sequentially. As a result, a refrigerant cycle for the heating operation of the air conditioner may be completed.

Referring to FIG. 1B, when a cooling operation signal is input into the air conditioner, the controller may perform a cooling operation of the air conditioner. For example, the cooling operation signal may be a signal arbitrarily input by the user. As another example, the cooling operation signal may be a signal which the thermostat provided in the indoor space provides to the controller when the indoor temperature sensed by the indoor-side temperature sensor is higher than a desired temperature set by the user by a predetermined level or more.

Specifically, the low-temperature and low-pressure refrigerant which is introduced from the accumulator 6 into the compressor 1 may be compressed at the high temperature and the high pressure by the compressor 1 and discharged to the oil separator 2. In addition, the refrigerant from which the oil is separated by the oil separator 2 may be introduced into the outdoor heat exchanger 4 via the switching valve 3 and the header 42.

As the heat energy is transferred from the refrigerant to the outdoor air in the outdoor heat exchanger 4, the refrigerant may be condensed. In this case, the outdoor heat exchanger 4 may serve as the condenser.

The refrigerant condensed while passing through the outdoor heat exchanger 4 may be introduced into the second indoor expansion valve E1*b* via the distributor 41, the outdoor expansion valve E2, and the second service valve SV2 sequentially. In this case, the outdoor expansion valve E2 may completely open the path. In addition, the refrigerant expanded while passing through the second indoor expansion valve E1*b* may be introduced into the second indoor heat exchanger 5*b*. Further, when a required cooling load increases, the first indoor expansion valve E1*a* and/or the third indoor expansion valve E1*c* may also be opened at a predetermined opening level.

As heat energy of the indoor energy is transferred to the refrigerant in the second indoor heat exchanger 5*b*, the refrigerant may be evaporated. In this case, the second indoor heat exchanger 5*b* may serve as an evaporator. In addition, the indoor space may be cooled according to the heat exchange between the refrigerant and the indoor air. The refrigerant evaporated while passing through the second indoor heat exchanger 5*b* may be introduced into the compressor 1 via the first service valve SV1, the switching valve 3, and the accumulator 6 sequentially. As a result, a refrigerant cycle for the cooling operation of the air conditioner may be completed.

Hereinafter, it is described as an example that the air conditioner according to the present disclosure performs the cooling operation, but the present is not limited thereto, and the present disclosure may be applied to the case where the air conditioner performs the heating operation in the same manner or similarly.

Figure 2:
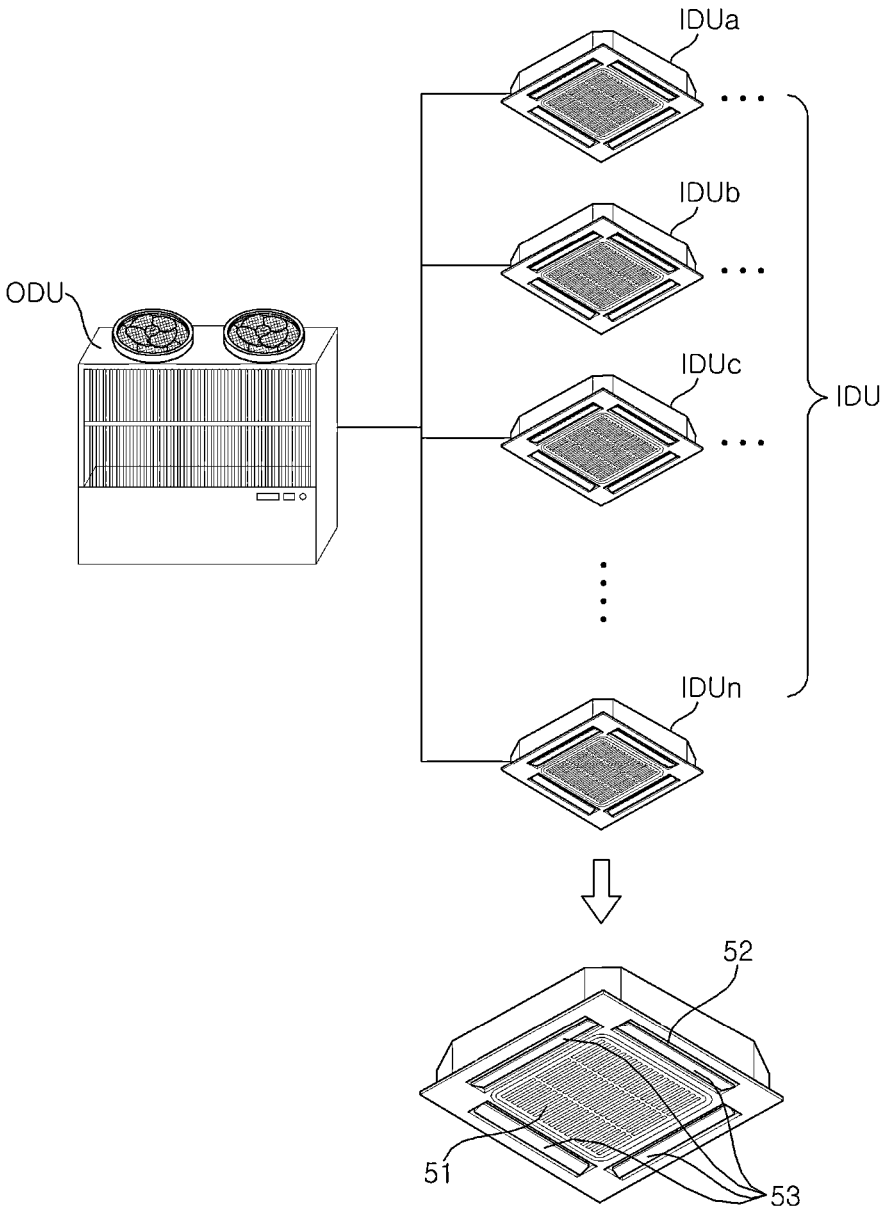
FIG. 2 is a diagram referenced for describing an air conditioner including a plurality of indoor units according to an embodiment of the present disclosure.

FIG. 2 is a diagram referenced for describing an air conditioner including a plurality of indoor units according to an embodiment of the present disclosure.

Referring to FIG. 2, a plurality of indoor units IDUa to IDUn may be connected to at least one outdoor unit ODU through the refrigerant pipe. The plurality of indoor units IDUa to IDUn may be installed in the indoor space to be spaced apart from each other. The plurality of indoor units IDUa to IDUn may occupy a plurality of regions constituting the indoor space, respectively. Meanwhile, two or more of the plurality of indoor units IDUa to IDUn may also occupy one of a plurality of regions constituting the indoor space.

In the present disclosure, it is described as an example that the indoor unit IDU is a ceiling type, but is not limited thereto. For example, the indoor unit IDU may include a suction hole 51 providing the indoor air to the indoor heat exchanger 5 of the indoor unit IDU, and a discharge hole 52 discharging the air which passes through the indoor heat exchanger 5 to the room, in response to the operation of the indoor fan. The indoor unit IDU may include a vane 53 which is movably installed in the discharge hole 52, and adjusts a direction of the air discharged to the room from the discharge hole 52. In the present disclosure, it is described as an example that the indoor unit IDU includes a plurality of vanes 53 corresponding to four directions.

Figure 3:
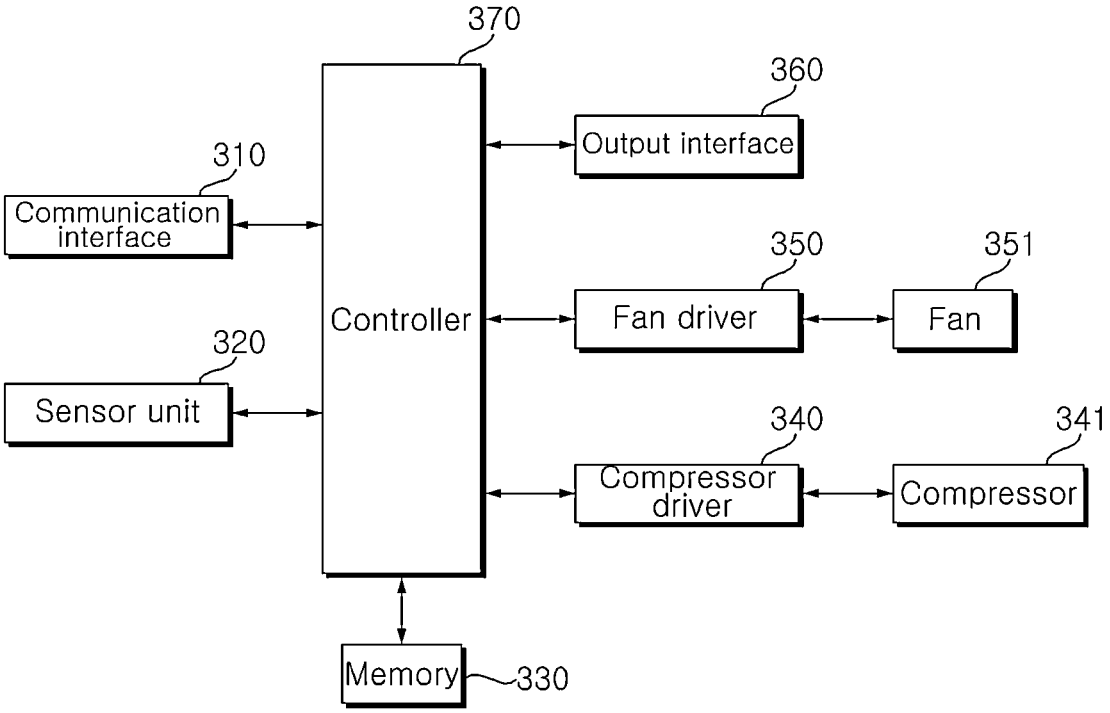
FIG. 3 is a block diagram of the air conditioner according to an embodiment of the present disclosure.

FIG. 3 is a block diagram of the air conditioner according to an embodiment of the present disclosure.

Referring to FIG. 3, the air conditioner may include a communication interface 310, a sensor unit 320, a memory 330, a fan driver 340 driving a fan 351, a compressor driver 350 driving a compressor 341 (the compressor 1 of FIG. 1A), and/or a controller 370.

The communication interface 310 may include at least one communication module. For example, the communication interface 310 may be provided in each of the outdoor unit ODU and the indoor unit IDU, and the outdoor unit ODU and the indoor unit IDU may transmit/receive data to/from each other. For example, the communication interface 310 may be provided in the remote control unit RCU.

A communication scheme of the outdoor unit ODU, the indoor unit IDU, and/or the remote control unit RCU may be, for example, a wireless communication scheme such as Wi-fi, Bluetooth, Beacon, ZigBee, etc., in addition to a wired communication scheme using a power line, a serial communication scheme (e.g., RS-485 communication), and a wired communication scheme through the refrigerant pipe.

The communication interface 310 may mutually transmit/receive data to/from an external device. For example, the communication interface 310 may also transmit/receive data by accessing a server connected to an external network.

The sensor unit 320 may include at least one sensor, and transmit data for a detection value detected through the sensor to the controller 370.

The sensor unit 320 may include a heat exchanger temperature sensor (not illustrated). For example, the heat exchanger temperature sensor may be disposed inside the indoor heat exchanger 5, and may detect a temperature of the indoor heat exchanger 5.

The sensor unit 320 may include a pipe temperature sensor (not illustrated). The pipe temperature sensor may detect a temperature of refrigerant which flows through each pipe of the air conditioner. For example, the pipe temperature sensor may be disposed at an inlet-side pipe of the indoor unit IDU and/or an outlet-side pipe of the indoor unit IDU, and may detect the temperature of the refrigerant which flows through the pipe. For example, the pipe temperature sensor may be disposed on a pipe connected to the compressor 341, and may detect a temperature (hereinafter, referred to as a suction temperature) of refrigerant introduced into the compressor 341 and/or a temperature (hereinafter, referred to as a discharge temperature) of refrigerant discharged from the compressor 341.

The sensor unit 310 may include a pressure sensor (not illustrated). The pressure sensor (not illustrated) may detect a pressure of gas refrigerant which flows through each pipe of the air conditioner. For example, the pressure sensor may be disposed on the pipe connected to the compressor 341, and may detect a pressure (hereinafter, referred to as a suction pressure) of the refrigerant introduced into the compressor 341 and/or a pressure (hereinafter, referred to as a discharge pressure) of the refrigerant discharged from the compressor 341.

The sensor unit 320 may include an indoor temperature sensor (not illustrated) detecting an indoor temperature and/or an outdoor temperature sensor (not illustrated) detecting an outdoor temperature.

The sensor unit 320 may include an indoor humidity sensor (not illustrated) detecting an indoor humidity and/or an outdoor humidity sensor (not illustrated) detecting an outdoor humidity.

The memory 330 may store data for a reference value related to the operation of each component provided in the air conditioner.

The memory 330 may store a program for processing and controlling each signal in the controller 370, and store processed data and data to be processed. For example, the memory 330 may store application programs designed for a purpose of performing various tasks which are enabled to be processed by the controller 370, and selectively provide some of the stored application programs upon a request by the controller 370.

The memory 330 may include, for example, at least one of a volatile memory (e.g., DRAM, SRAM, SDRAM, etc.) or a non-volatile memory (e.g., a flash memory, a hard disk drive (HDD), a solid-state drive (SSD), etc.).

The fan driver 340 may drive the fan 351 provided in the air conditioner. For example, the fan 351 may include an outdoor fan and/or an indoor fan.

The fan driver 340 may include a rectifier (not illustrated) rectifying and outputting an alternating current (AC) power into a direct current (DC) power, and outputting the DC power, a dc-terminal capacitor (not illustrated) storing a pulse voltage from the rectifier, an inverter (not illustrated) including a plurality of switching elements, and converting and outputting a smoothed DC power into a 3-phase AC power having a predetermined frequency, and/or at least one motor driving the fan 351 driving the fan 351 according to the 3-phase AC power output from the inverter.

Meanwhile, the fan driver 340 may separately include components for driving the outdoor fan and the indoor fan, respectively. For example, the air conditioner may include a first fan driver for driving the outdoor fan and a second fan driver for driving the indoor fan.

The compressor driver 350 may drive the compressor 341. The compressor driver 350 may include a rectifier (not illustrated) rectifying and outputting the alternating current (AC) power into the direct current (DC) power, and outputting the DC power, a dc-terminal capacitor (not illustrated) storing the pulse voltage from the rectifier, an inverter (not illustrated) including the plurality of switching elements, and converting and outputting the smoothed DC power into the 3-phase AC power having a predetermined frequency, and/or a compressor motor 102*b* driving the compressor 341 according to the 3-phase AC power output from the inverter.

The controller 370 may control an overall operation of the air conditioner. The controller 370 may connected to each component provided in the air conditioner, and transmits and/or receives a signal to/from each component to control the overall operation of each component.

The controller 370 controls an operation of the fan driver 340 to change an RPM of the fan 351. For example, the fan driver 340 changes the frequency of the 3-phase AC power output to an outdoor fan motor according to the control by the controller 370 to change an RPM of the outdoor fan. For example, the fan driver 340 changes the frequency of the 3-phase AC power output to the outdoor fan motor according to the control by the controller 370 to change an RPM of the indoor fan.

The controller 370 controls an operation of the compressor driver 350 to change an operating frequency of the compressor 341. For example, the compressor driver 350 changes the frequency of the 3-phase AC power output to the compressor motor 102*b* according to the control by the controller 370 to change the operating frequency of the compressor 341.

The controller 370 may also be provided in the indoor unit IDU, the outdoor unit ODU, and/or the remote control unit RCU.

The controller 370 may include at least one processor, and control an overall operation of the air conditioner by using a processor included in the controller 370. Here, the processor may be a general processor such as a central processing unit (CPU). Of course, the processor a dedicated device such as ASIC or another hardware based processor.

The controller 370 may acquire data related to each component provided in the air conditioner. In this case, the controller 370 may also acquire the data related to each component provided in the air conditioner at a predetermined time interval according to a predetermined cycle by considering a computational load.

The controller 370 may perform various computations based on the acquired data, and control the overall operation of each component provided in the air conditioner according to a computational result.

The data related to each component provided in the air conditioner may include, for example, the operating frequency of the compressor 341, the suction temperature, the discharge temperature, the suction pressure, and the discharge pressure of the compressor 341, the inlet-side pipe temperature of the indoor unit IDU, the outlet-side pipe temperature of the indoor unit IDU, the indoor temperature, the outdoor temperature, the opening level of the electronic expansion valve EEV, etc.

Meanwhile, the air conditioner may further include an input device (not illustrated) which may receive a user input. For example, when the user input is received through the input device (e.g., a touch panel, a key, etc.), the air conditioner may perform an operation corresponding to the received user input.

The air conditioner may further include an output interface 360 which outputs a message for an operating state. For example, the output interface 360 may include a display device such as a display, a light emitting diode (LED), etc., and/or an audio device such as a speaker, a buzzer, etc.

Figure 4:
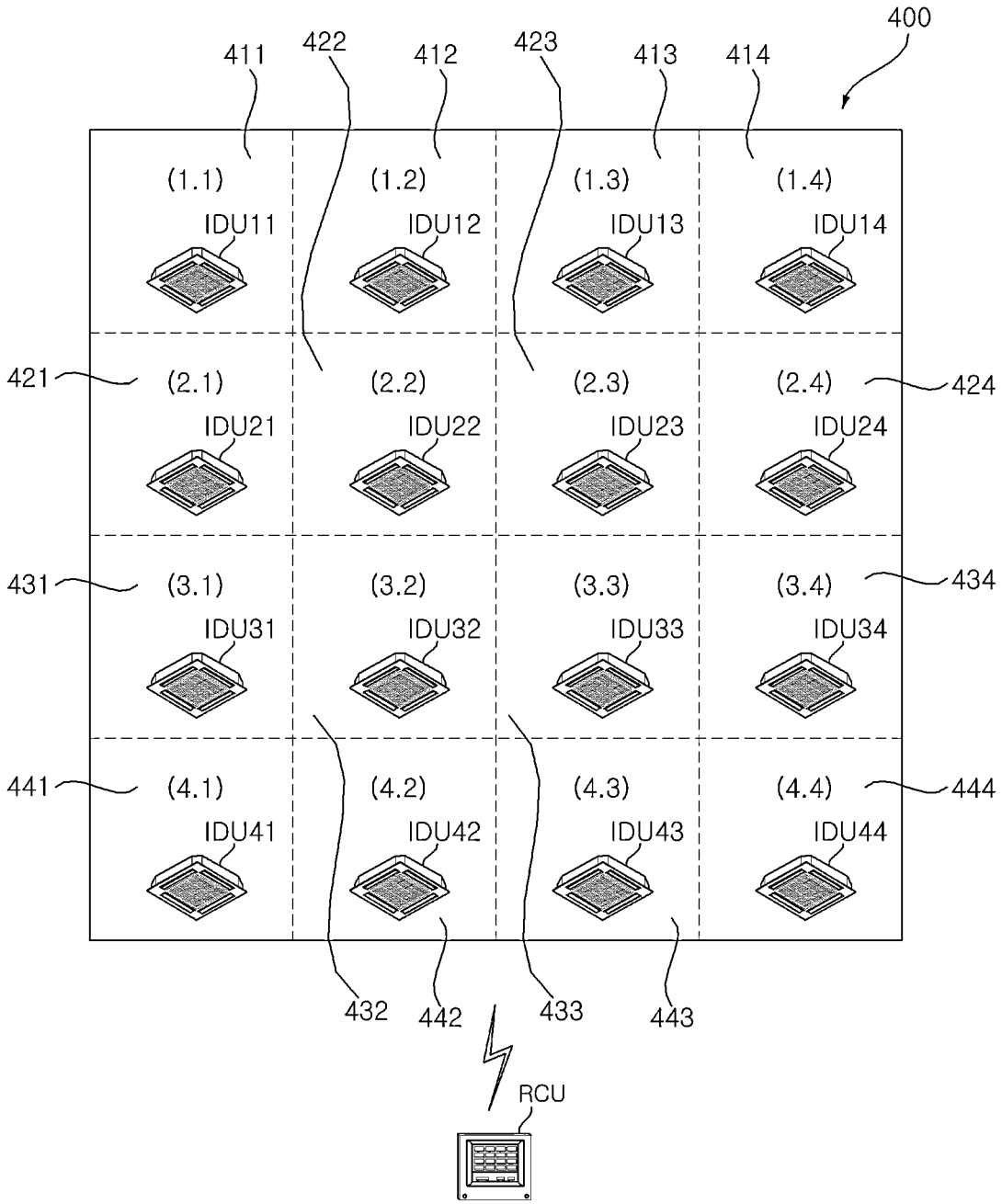
FIG. 4 is a diagram referenced for describing locations of a plurality of indoor units disposed in an indoor space according to an embodiment of the present disclosure.

FIG. 4 is a diagram referenced for describing locations of a plurality of indoor units disposed in an indoor space according to an embodiment of the present disclosure.

Referring to FIG. 4, a plurality of indoor units IDU11 to IDU44 may be disposed in an indoor space 400. The plurality of indoor units IDU11 to IDU44 may correspond to a plurality of regions 411 to 444 constituting the indoor space 400, respectively. The plurality of regions 411 to 444 constituting the indoor space 400 may be in communication with each other.

Operating the plurality of indoor units IDU11 to IDU44 may influence an adjacent region. For example, when the air conditioner performs the cooling operation while a first indoor unit IDU11 is in operation, cooling air may be discharged from the first indoor unit IDU11 to a first region 411. In this case, a temperature of the first region 411 may be lowered by the cooling air discharged from the first indoor unit IDU11. Meanwhile, as the temperature of the first region 411 is lowered, temperatures of a second region 412 and a fifth region 421 adjacent to the first region 411 may be lowered.

Each of the plurality of indoor units IDU11 to IDU44 may acquire data regarding a corresponding region among the plurality of regions 411 to 444. For example, each of the plurality of indoor units IDU11 to IDU44 may detect an indoor temperature and/or an indoor humidity of a corresponding region among the plurality of regions 411 to 444.

The air conditioner may store location information of the plurality of indoor units IDU11 to IDU44. location information of the plurality of indoor units IDU11 to IDU44 may be coordinates. The location information of the plurality of indoor units IDU11 to IDU44 may be registered by a user. For example, the user may input the location information of the plurality of indoor units IDU11 to IDU44 through the input device included in the remote control unit RCU.

The location information of the plurality of indoor units IDU11 to IDU44 may be transmitted to the plurality of indoor units IDU11 to IDU44, respectively. Each of the plurality of indoor units IDU11 to IDU44 may acquire data regarding an adjacent indoor unit based on the location information of the plurality of indoor units IDU11 to IDU44. For example, an indoor unit adjacent to the first indoor unit IDU11 may be a second indoor unit IDU 12 and a fifth indoor unit IDU21. For example, an indoor unit adjacent to a sixth indoor unit IDU22 may be the second indoor unit IDU12, the fifth indoor unit IDU21, a seventh indoor unit IDU23, and a tenth indoor unit IDU32.

According to an embodiment, each of the plurality of indoor units IDU11 to IDU44 may collect regarding another indoor unit by using a depth-first search (DFS) algorithm. For example, each of the plurality of indoor units IDU11 to IDU44 may acquire an operating state of another indoor unit, an indoor temperature of a region corresponding to another indoor unit, etc. To this end, the air conditioner may include indoor temperature sensors that sense indoor temperatures for the plurality of regions 411 to 444 corresponding to the plurality of indoor units IDU11 to IDU44, respectively. The indoor temperature sensor may be disposed in the plurality of indoor units IDU11 to IDU44, respectively.

Meanwhile, the remote control unit RCU may acquire data regarding the plurality of indoor units IDU11 to IDU44 based on the location information of the plurality of indoor units IDU11 to IDU44.

Figure 5:
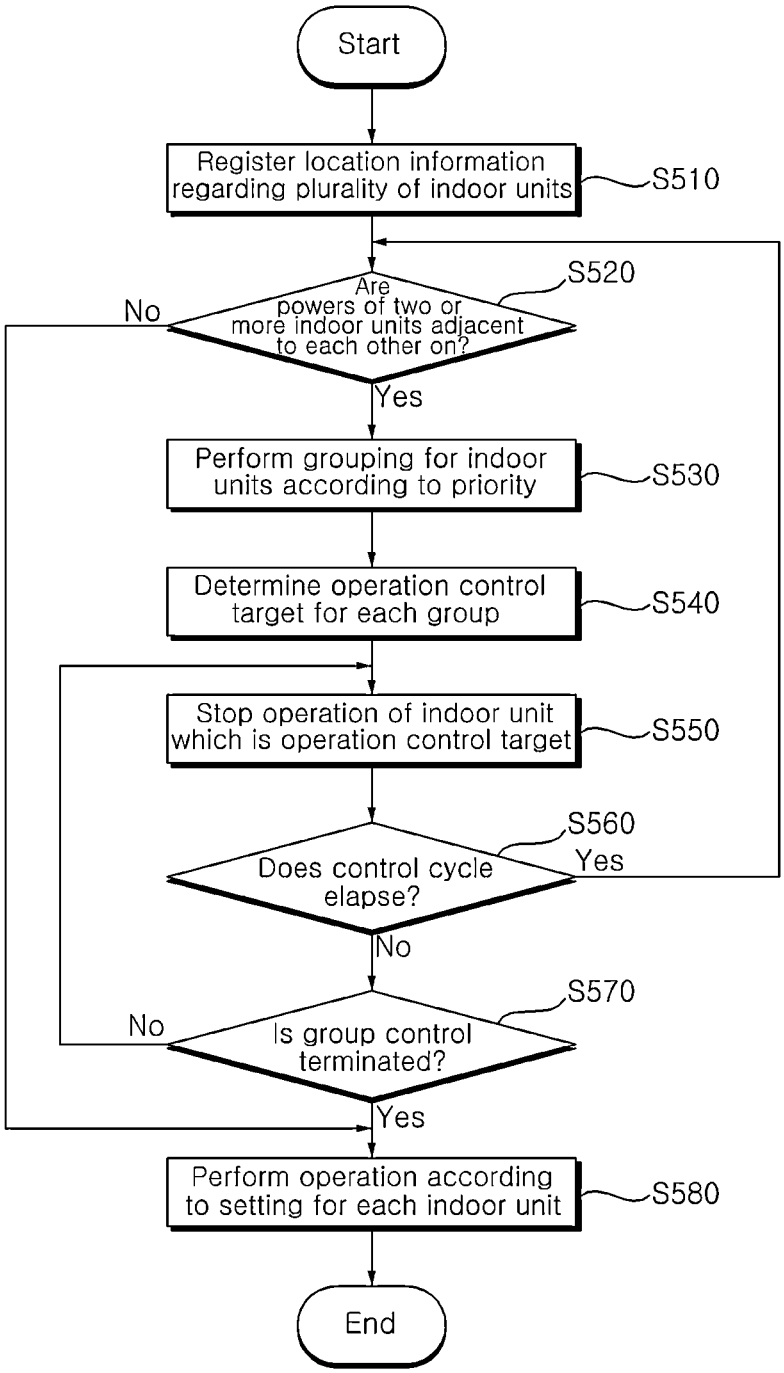
FIG. 5 is a flowchart for an operating method of an air conditioner according to an embodiment of the present disclosure.

FIG. 5 is a flowchart for an operating method of an air conditioner according to an embodiment of the present disclosure. A detailed description of contents duplicated with the contents described in FIGS. 1A to 4 will be omitted.

Referring to FIG. 5, the air conditioner may register location information for a plurality of indoor units IDU in operation S510. For example, the air conditioner may register the location information for the plurality of indoor units IDU based on coordinates corresponding to the plurality of indoor units IDU, which are received through the remote control unit RCU, respectively.

The air conditioner may check whether powers of two or more indoor units IDU adjacent to each other among the plurality of indoor units IDU are on.

The air conditioner may perform grouping for the plurality of indoor units IDU according to a priority for an operation control when the powers of two or more indoor units IDU adjacent to each other are on in operation S530. For example, the air conditioner may perform grouping for the plurality of indoor units IDU based on an indoor temperature of a corresponding region, a set target temperature, the number of adjacent indoor units which are in operation, etc., for each of the plurality of indoor units IDU. In this case, a target of the grouping for the plurality of indoor units IDU may correspond to an indoor unit adjacent to the indoor unit in which power is on among the plurality of indoor units IDU. For example, when the powers of the second indoor unit IDU12 and the fifth indoor unit IDU21 are off while the first indoor unit IDU11 is in operation, the first indoor unit IDU11 may be excluded from the grouping target.

According to an embodiment, the air conditioner may determine a target excess indoor unit among the plurality of indoor units IDU. For example, the air conditioner may determine, as the target excess indoor unit, an indoor unit in which the indoor temperature of the corresponding region is less than a target temperature among the plurality of indoor units IDU during the cooling operation. For example, the air conditioner may determine, as the target excess indoor unit, an indoor unit in which the indoor temperature of the corresponding region is more than the target temperature among the plurality of indoor units IDU during the heating operation.

In this case, when there is one target excess indoor unit, one indoor unit IDU determined as the target excess indoor unit may be included in a first group corresponding to a first priority. Meanwhile, when there are two or more target excess indoor units, a target excess indoor unit having the largest number of indoor units in operation therearound among a plurality of target excess indoor units may be included in the first group, and the remainder of the plurality of target excess indoor units may be included in a second group corresponding to a second priority. For example, when there are two target excess indoor units adjacent to three indoor units which are in operationamong the plurality of target excess indoor unit, and three target excess indoor units adjacent to one indoor unit which is in operation, two indoor units IDU adjacent to three indoor units which are in operation may be included in the first group, and three indoor units IDU adjacent to one indoor unit which is in operation may be included in the second group.

Meanwhile, the air conditioner may determine an indoor unit (hereinafter, referred to as a target reach indoor unit) in which an indoor temperature of a corresponding region and the target temperature are the same among the plurality of indoor units IDU. In this case, all target reach indoor units may be included in a third group corresponding to a third priority. Meanwhile, an indoor unit IDU which is not included in the first to third groups may also be included in a fourth group.

The air conditioner may determine an indoor unit IDU which is the target of the operation control for each group with respect to the plurality of indoor units IDU grouped according to the priority in operation S540. In this case, all indoor units IDU included in the fourth group may be excluded from the target of the operation control.

According to an embodiment, the air conditioner may determine all indoor units IDU included in the first group as the target of the operation control.

According to an embodiment, the air conditioner may determine, as the target of the operation control, at least one of the indoor units IDU included in the second group, which are not adjacent to the indoor unit IDU included in the first group. In this case, when there are two or more indoor units IDU included in the second group, which are not adjacent to the indoor unit IDU included in the first group, a sequence may be determined which is determined as the target of the operation control in the second group according to a predetermined condition. Here, the predetermined condition may include a first condition for the number of adjacent indoor units which are in operation, a second condition for the target temperature, etc.

For example, an indoor unit having the largest number of indoor units in operation therearound among the indoor units IDU included in the second group, which are not adjacent to the indoor unit IDU included in the first group may satisfy the first condition. In this case, the indoor unit that satisfies the first condition may correspond to a first ranking determined as the target of the operation control in the second group. Meanwhile, an indoor unit may satisfy the second condition, which does not satisfy the first condition and has the highest target temperature upon cooling or the lowest target temperature upon heating, among the indoor units IDU included in the second group, which are not adjacent to the indoor unit IDU included in the first group. In this case, the indoor unit corresponding to the second condition may correspond to a second ranking determined as the target of the operation control in the second group. Meanwhile, an indoor unit which does not satisfy the first condition and the second condition among the indoor units IDU included in the second group, which are not adjacent to the indoor unit IDU included in the first group may correspond to a third ranking determined as the target of the operation control in the second group. The air conditioner may sequentially determine, as the target of the operation control, the indoor unit IDU which corresponds to the first ranking in the second group, the second ranking in the second group, and the indoor unit IDU corresponding to the third ranking in the second group each time a control cycle elapses.

According to an embodiment, the air conditioner may determine, as the target of the operation control, at least one of the indoor units IDU included in the third group, which are not adjacent to the indoor unit determined as the target of the operation control among the indoor units IDU included in the first group and the indoor units IDU included in the second group. In this case, when there are two or more indoor units IDU included in the third group, which are not adjacent to the indoor unit determined as the target of the operation control among the indoor units IDU included in the first group and the indoor units IDU included in the second group, a sequence may be determined, which is determined as the target of the operation control in the third group according to a predetermined condition.

For example, among the indoor units IDU included in the third group, which are not adjacent to the indoor unit determined as the target of the operation control among the indoor units IDU included in the first group and the indoor units IDU included in the second group, an indoor unit having the largest number of indoor units in operation therearound may correspond to the first condition. In this case, the indoor unit corresponding to the first condition may correspond to the first ranking determined as the target of the operation control in the third group. Meanwhile, an indoor unit may satisfy the second condition, which does not correspond to the first condition and has the highest target temperature upon cooling or the lowest target temperature upon heating, among the indoor units IDU included in the third group, which are not adjacent to the indoor unit determined as the target of the operation control among the indoor units IDU included in the first group and the indoor units IDU included in the second group. In this case, the indoor unit corresponding to the second condition may correspond to the second ranking determined as the target of the operation control in the third group. Meanwhile, an indoor unit which does not correspond to the first condition and the second condition among the indoor units IDU included in the third group, which are not adjacent to the indoor unit determined as the target of the operation control among the indoor units IDU included in the first group and the indoor units IDU included in the second group may correspond to a third ranking determined as the target of the operation control in the third group. The air conditioner may sequentially determine, as the target of the operation control, the indoor units IDU corresponding to the first ranking in the third group one by one each time the control cycle elapses. Further, when all indoor units IDU corresponding to the first raking in the third group are determined as the target of the operation control at a previous control cycle, the air conditioner may sequentially determine the indoor units IDU corresponding to the second ranking in the third group as the target of the operation control one by one. Further, when all indoor units IDU corresponding to the second raking in the third group are determined as the target of the operation control at the previous control cycle, the air conditioner may sequentially determine the indoor units IDU corresponding to the third ranking in the third group as the target of the operation control one by one.

The air conditioner may stop the operation of the indoor unit IDU determined as the target of the operation control in operation S550. The air conditioner may stop the operation of the indoor unit IDU determined as the target of the operation control in operation S550.

The air conditioner may determine whether a predetermined control cycle elapses in operation S560. The control cycle may be changed according to the setting of the user. For example, the control cycle may be set to 30 minutes, 1 hour, 2 hours, etc.

The air conditioner may determine whether a group control of grouping and controlling the plurality of indoor units IDU is terminated when the predetermined control cycle does not elapse in operation S570. For example, the user may set whether the group control is activated through the remote control unit RCU.

Meanwhile, when the setting for the indoor unit IDU determined as the target of the operation control is changed by the user, the indoor unit IDU for which setting is changed may operate according to the setting changed by the user. For example, when a target temperature of an indoor unit IDU which is determined as the target of the operation control and of which operation is stopped is changed, the indoor unit IDU may perform the operation according to the changed target temperature until the predetermined control cycle elapses.

The air conditioner may perform the operation with respect to each of the plurality of indoor units IDU according to the setting for each indoor unit IDU in operation S580. For example, when a power of only one of the plurality of indoor units IDU is on, when either of all indoor units of which powers are on among the plurality of indoor units IDU are not adjacent to each other, or when the group control is deactivated, the air conditioner may perform the operation with respect to each of the plurality of indoor units IDU according to the setting for each indoor unit IDU.

FIGS. 6 to 11 are diagrams referenced for describing an operation of the air conditioner according to an embodiment of the present disclosure. In FIGS. 6 to 11, a cooling target temperature for each region may be displayed at a left side and the indoor temperature may be displayed at a right side.

Figure 6:
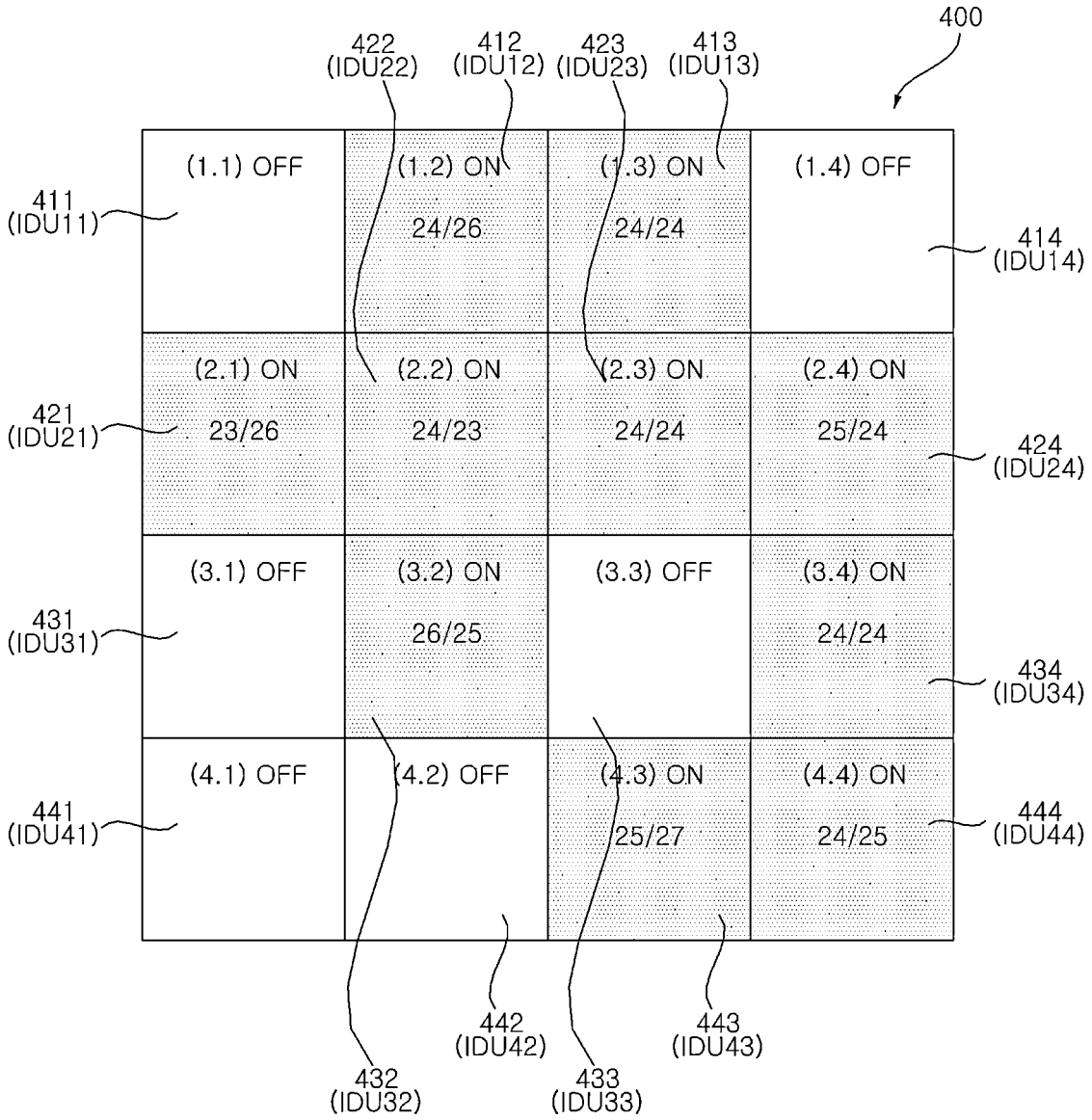

Referring to FIG. 6, among a plurality of indoor units IDU disposed in a plurality of regions constituting the indoor space 400, powers of a second indoor unit IDU12, a third indoor unit IDU13, fifth to eighth indoor units IDU21 to IDU24, a tenth indoor unit IDU 32, a twelfth indoor unit IDU34, a fifteenth indoor unit IDU43, and a sixteenth indoor unit IDU44 may be on.

Referring to reference numeral 701 of FIG. 7, the sixth indoor unit IDU 22, the eighth indoor unit IDU24, and the tenth indoor unit IDU32 in which the target temperature is higher than the indoor temperature among the plurality of indoor units IDU may be determined as the target excess indoor unit. Further, the sixth indoor unit IDU22 adjacent to four indoor units which are in operation may be included in the first group, and the eighth indoor unit IDU24 and the tenth indoor unit IDU32 may be included in the second group. Further, the third indoor unit IDU13, the seventh indoor unit IDU23, and the twelfth indoor unit IDU34 in which the target temperature and the indoor temperature are the same among the plurality of indoor units IDU may be included in the third group.

Referring to reference numeral 702 of FIG. 7, the sixth indoor unit IDU22 included in the first group may be determined as the target of the operation control. Further, as the tenth indoor unit IDU32 adjacent to the first group is excluded from the target of the operation controller, the eighth indoor unit IDU24 included in the second group may be determined as the target of the operation control. Further, as the seventh indoor unit IDU23 and the twelfth indoor unit IDU34 adjacent to the first group and/or the second group are excluded from the target of the operation control, the third indoor unit IDU13 included in the third group may be determined as the target of the operation control.

While the control cycle elapses, the operations of the third indoor unit IDU13, the sixth indoor unit IDU22, and the eighth indoor unit IDU24 determined as the target of the operation control may be stopped.

Referring to reference numeral 801 of FIG. 8, when the control cycle elapses, the indoor units IDU included in the first group, the second group, and the third group may be updated. First, as the target temperature becomes lower than the indoor temperature, the third indoor unit IDU13 may be excluded from the third group. Further, the sixth indoor unit IDU22, the eighth indoor unit IDU24, and the sixteenth indoor unit IDU44 may be newly included in the third group as the target temperature and the indoor temperature are the same. Meanwhile, since the tenth indoor unit IDU32 is a unique indoor unit which the target temperature is higher than the indoor temperature among the plurality of indoor units IDU, the tenth indoor unit IDU32 may be included in the first group.

Referring to reference numeral 802 of FIG. 8, the operation of the third indoor unit IDU13 excluded from the third group may be resumed. Further, the operations of the sixth indoor unit IDU22, and the eighth indoor unit IDU24 which are determined as the target of the operation control and of which operations are stopped during an immediately previous control cycle may also be resumed.

The tenth indoor unit IDU32 included in the first group may be determined as the target of the operation control. The sixth indoor unit IDU22, the eighth indoor unit IDU24, and the sixteenth indoor unit IDU44 newly added to the third group may be excluded from the target of the operation control. Meanwhile, any one of the seventh indoor unit IDU23 and the twelfth indoor unit IDU34 included in the third group may be determined as the target of the operation control. In this case, as target temperatures of the seventh indoor unit IDU23 and the twelfth indoor unit IDU34 are the same, the seventh indoor unit IDU 23 adjacent to more indoor units which are in operation may be determined as the target of the operation control. Meanwhile, a sequence of the sixth indoor unit IDU22, and the eighth indoor unit IDU24 which are determined as the target of the operation control and of which operations are stopped during the immediately previous control cycle, which are determined as the target of the operation control in the third group may correspond to a final ranking.

While the control cycle elapses, the operations of the seventh indoor unit IDU23 and the tenth indoor unit IDU32 which are determined as the target of the operation control may be stopped.

Referring to reference numeral 901 of FIG. 9, when the control cycle elapses, the indoor units IDU included in the first group, the second group, and the third group may be updated. The third indoor unit IDU13, the tenth indoor unit IDU32, and the fifteenth indoor unit IDU43 may be newly included in the third group as the target temperature and the indoor temperature are the same.

Referring to reference numeral 902 of FIG. 9, the operations of the seventh indoor unit IDU23 and the tenth indoor unit IDU32 which are determined as the target of the operation control and of which operations are stopped during the immediately previous control cycle may be resumed.

According to a sequence determined as the target of the operation control among the indoor units IDU included in the third group, the twelfth indoor unit IDU34 may be determined as the target of the operation control. While the control cycle elapses, the operation of the twelfth indoor unit IDU34 which is determined as the target of the operation control may be stopped.

Referring to reference numeral 1001 of FIG. 10, when the control cycle elapses, the indoor units IDU included in the first group, the second group, and the third group may be updated. First, as the target temperature becomes lower than the indoor temperature, the twelfth indoor unit IDU34 may be excluded from the third group. Further, as the target temperature and the indoor temperature are the same, the second indoor unit IDU12 may be newly included in the third group.

Meanwhile, since the target temperature is higher than the indoor temperature in the sixth indoor unit IDU22 and the seventh indoor unit IDU23, the sixth indoor unit IDU22 and the seventh indoor unit IDU23 may correspond to the target excess indoor unit. In this case, the sixth indoor unit IDU22 adjacent to more indoor units which are in operation may be included in the first group, and the seventh indoor unit IDU23 may be included in the second group.

Referring to reference numeral 1002 of FIG. 10, the operation of the twelfth indoor unit IDU34 which is excluded from the third group may be resumed.

The sixth indoor unit IDU22 included in the first group may be determined as the target of the operation control. The seventh indoor unit IDU23 which is included in the second group, but is adjacent to the first group may be excluded from the target of the operation control. Further, the second indoor unit IDU12 newly added to the third group may be excluded from the target of the operation control. Meanwhile, according to a sequence determined as the target of the operation control among the indoor units IDU included in the third group, the sixth indoor unit IDU44 may be determined as the target of the operation control.

While the control cycle elapses, the operations of the sixth indoor unit IDU22 and the twelfth indoor unit IDU34 which are determined as the target of the operation control may be stopped.

Referring to reference numeral 1101 of FIG. 11, when the control cycle elapses, the indoor units IDU included in the first group, the second group, and the third group may be updated. First, as the power of the sixth indoor unit IDU22 is off, the tenth indoor unit IDU32 may be excluded from the grouping target. Further, as the target temperature and the indoor temperature are the same, the twelfth indoor unit IDU34 may be newly included in the third group. Meanwhile, since the tenth indoor unit IDU32 is a unique indoor unit which the target temperature is higher than the indoor temperature among the plurality of indoor units IDU, the seventh indoor unit IDU23 may be included in the first group.

Referring to reference numeral 1102 of FIG. 11, the operation of the sixteenth indoor unit IDU44 which is determined as the target of the operation control and of which operation is stopped during the immediately previous control cycle may be resumed.

The seventh indoor unit IDU23 included in the first group may be determined as the target of the operation control. According to a sequence determined as the target of the operation control among the indoor units IDU included in the third group, the eleventh indoor unit IDU43 may be determined as the target of the operation control. Meanwhile, a sequence of the sixteenth indoor unit IDU44 which is determined as the target of the operation control and of which operation is stopped during the immediately previous control cycle, which is determined as the target of the operation control in the third group may correspond to a final ranking.

While the control cycle elapses, the operations of the seventh indoor unit IDU23 and the fifteenth indoor unit IDU43 which are determined as the target of the operation control may be stopped.

As described above, according to at least one embodiment of the present disclosure, the plurality of indoor units IDU may be grouped according to the priority for the operation control.

Further, according to at least one embodiment of the present disclosure, an indoor unit IDU which is the target of the operation control may be determined by considering an influence exerted on an adjacent region.

In addition, according to at least one embodiment of the present disclosure, an unnecessary operation control for the indoor unit IDU may be minimized.

Referring to FIGS. 1A to 11, the air conditioner according to an embodiment of the present disclosure may include: an outdoor unit ODU; a plurality of indoor units IDU disposed to correspond to a plurality of regions, respectively; temperature sensors sensing indoor temperatures for the plurality of regions corresponding to the plurality of indoor units IDU, respectively; and a controller 370, and the controller 370 may group the plurality of indoor units IDU into at least one group when powers of two or more indoor units IDU adjacent to each other among the plurality of indoor units IDU, determine at least one of the plurality of indoor units IDU as a target of an operation control based on a priority for the at least one group, and stop an operation of the indoor unit IDU determined as the target of the operation control.

Further, according to an embodiment of the present disclosure, the plurality of regions may constitute continuous indoor spaces 400 which are in communication with each other.

Further, according to an embodiment of the present disclosure, the controller 370 may stop the operation of the indoor unit IDU determined as the target of the operation control during a predetermined control cycle, and update an indoor unit IDU included in at least one group when the predetermined control cycle elapses.

Further, according to an embodiment of the present disclosure, the controller 370 may include, when there is a single first indoor unit IDU in which an indoor temperature of a corresponding region is lower than a target temperature upon cooling or higher than the target temperature upon heating, the first indoor unit IDU in a first group which has a first priority, include, when there are a plurality of first indoor units IDU, at least one of the plurality of first indoor units IDU having the largest number of indoor units in operation therearound in the first group and the remainder of the plurality of first indoor units in a second group which has a second priority lower than the first priority.

Further, according to an embodiment of the present disclosure, the controller 370 may determine, as the target of the operation control, all indoor units IDU included in the first group, and determine, as the target of the operation control, at least one which is not adjacent to the indoor unit IDU included in the first group among indoor units IDU included in the second group.

Further, according to an embodiment of the present disclosure, the controller 370 may determine, as the target of the operation control, a second indoor unit IDU which is not adjacent to the indoor unit IDU included in the first group, and has the largest number of indoor units IDU in operation therearound, among the indoor units IDU included in the second group.

Further, according to an embodiment of the present disclosure, when there are a plurality of second indoor units IDU, the controller 370 may determine all of the plurality of second indoor units IDUs as the target of the operation control.

Further, according to an embodiment of the present disclosure, the controller 370 may include a third indoor unit IDU in which the indoor temperature of the corresponding region and the target temperature are the same in a third group which has a third priority lower than the second priority.

Further, according to an embodiment of the present disclosure, the controller 370 may determine, as the target of the operation control, at least one of the indoor unit IDU included in the first group and the indoor unit IDU included in the second group, and determine, as the target of the operation control, at least one which is not adjacent to the indoor unit IDU determined as the target of the operation control among the indoor unit IDU included in the first group and the indoor unit IDU included in the second group among the indoor units IDU included in the third group.

Further, according to an embodiment of the present disclosure, the controller 370 may exclude a fourth indoor unit IDU of which power is off and a fifth indoor unit IDU adjacent to all indoor units IDU of which powers are off among the plurality of indoor units IDU from the target of the operation control.

It is to be understood that the accompanying drawings are just used for easily understanding the embodiments disclosed in the present disclosure and a technical spirit disclosed in the present disclosure is not limited by the accompanying drawings and all changes, equivalents, or substitutes included in the spirit and the technical scope of the present disclosure are included.

Meanwhile, an operating method of the present disclosure may be implemented as a processor readable code in a processor readable recording medium. The processor readable recording medium includes all kinds of recording devices storing data which may be deciphered by a processor. Examples of the processor readable recording medium include a ROM, a RAM, a CD-ROM, a magnetic tape, a floppy disk, an optical data storage device, and the like and further include a device implemented as a type of a carrier wave such as transmission through the Internet. Further, the processor readable recording media may be stored and executed as codes which may be distributed in the computer system connected through a network and read by the processor in a distribution method.

Further, while the embodiments of the present disclosure have been illustrated and described above, the present disclosure is not limited to the aforementioned specific embodiments, various modifications may be made by a person with ordinary skill in the technical field to which the present disclosure pertains without departing from the subject matters of the present disclosure that are claimed in the claims, and these modifications should not be appreciated individually from the technical spirit or prospect of the present disclosure.

What is claimed is:

1. An air conditioner comprising:

an outdoor unit;

a plurality of indoor units disposed to correspond to a plurality of regions, respectively;

temperature sensors configured to sense indoor temperatures for the plurality of regions corresponding to the plurality of indoor units, respectively; and a controller configured to:

group the plurality of indoor units into at least one group when powers of two or more indoor units adjacent to each other among the plurality of indoor units are on, determine at least one of the plurality of indoor units as a target of an operation control based on a priority for the at least one group, and stop an operation of the indoor unit determined as the target of the operation control.

2. The air conditioner of claim 1, wherein the plurality of regions constitute continuous indoor spaces which are in communication with each other.

3. The air conditioner of claim 1, wherein the controller is configured to:

stop the operation of the indoor unit determined as the target of the operation control during a predetermined control cycle, and updates an indoor unit included in the at least one group when the predetermined control cycle elapses.

4. The air conditioner of claim 1, wherein the controller is configured to:

when there is a single first indoor unit in which an indoor temperature of a corresponding region is lower than a target temperature upon cooling or higher than the target temperature upon heating, include the first indoor unit in a first group which has a first priority, and when there are a plurality of first indoor units, include at least one of the plurality of first indoor units having the largest number of indoor units in operation therearound in the first group, and include the remainder of the plurality of first indoor units in a second group which has a second priority lower than the first priority.

5. The air conditioner of claim 4, wherein the controller is configured to:

determine all included in the first group as the target of the operation control, and determine, as the target of the operation control, at least one not adjacent to the indoor unit included in the first group among the indoor units included in the second group.

6. The air conditioner of claim 5, wherein the controller is configured to determine, as the target of the operation control, a second indoor unit which is not adjacent to the indoor unit included in the first group and has the largest number of indoor units in operation therearound, among the indoor units included in the second group.

7. The air conditioner of claim 6, wherein the controller is configured to determine, when there are a plurality of second indoor units, all of the plurality of second indoor units as the target of the operation control.

8. The air conditioner of claim 4, wherein the controller is configured to include a third indoor unit in which the indoor temperature of the corresponding region and the target temperature are the same in a third group which has a third priority lower than the second priority.

9. The air conditioner of claim 8, wherein the controller is configured to:

determine, as the target of the operation control, at least one of the indoor unit included in the first group and the indoor unit included in the second group, and determine, as the target of the operation control, at least one which is not adjacent to the indoor unit determined as the target of the operation control among the indoor unit included in the first group and the indoor unit included in the second group, among indoor units included in the third group.

10. The air conditioner of claim 1, wherein the controller is configured to exclude a fourth indoor unit of which power is off and a fifth indoor unit adjacent to all indoor units of which powers are off among the plurality of indoor units from the target of the operation control.

* * * * *